US011452428B2

(12) United States Patent
Meszaros et al.

(10) Patent No.: US 11,452,428 B2
(45) Date of Patent: Sep. 27, 2022

(54) CLEANING PAD HANDLES AND SYSTEMS

(71) Applicant: DAKOTA SUPPLIES INC., Calgary (CA)

(72) Inventors: Garner Meszaros, Langdon (CA); Vaughan Payne, Calgary (CA); Deborah Humphries, Calgary (CA)

( * ) Notice: Subject to any disclaimer, the term of this patent is extended or adjusted under 35 U.S.C. 154(b) by 295 days.

(21) Appl. No.: 16/670,313

(22) Filed: Oct. 31, 2019

(65) Prior Publication Data

US 2020/0129037 A1 Apr. 30, 2020

Related U.S. Application Data

(60) Provisional application No. 62/753,171, filed on Oct. 31, 2018.

(51) Int. Cl.

| | |
|---|---|
| ***A47L 13/254*** | (2006.01) |
| ***A47L 13/44*** | (2006.01) |
| *A47L 13/17* | (2006.01) |

(52) U.S. Cl.

CPC ..... *A47L 13/254* (2013.01); *A47L 13/44* (2013.01); *A47L 13/17* (2013.01)

(58) Field of Classification Search

CPC ..... A47L 13/254; A47L 13/255; A47L 13/44; A47L 13/16; A47L 13/17; B25G 3/02

See application file for complete search history.

(56) References Cited

U.S. PATENT DOCUMENTS

| | | | | |
|---|---|---|---|---|
| 3,827,099 | A * | 8/1974 | Allaire | A47L 13/20 15/229.1 |
| 6,550,092 | B1 * | 4/2003 | Brown | A47L 25/005 15/209.1 |
| 7,574,768 | B2 * | 8/2009 | Morris | B25G 3/28 15/143.1 |
| 8,834,484 | B2 * | 9/2014 | Kehres | A61B 17/00 606/99 |
| 10,098,445 | B1 * | 10/2018 | Morad | A46B 5/0095 |
| 10,194,776 | B2 * | 2/2019 | Payne | A47L 13/20 |
| 2005/0039286 | A1 * | 2/2005 | Brinker | B25G 3/24 15/228 |
| 2005/0055787 | A1 * | 3/2005 | Blum | A47K 11/10 15/104.94 |
| 2005/0056558 | A1 * | 3/2005 | Belser | B65D 81/025 206/362 |
| 2008/0263797 | A1 * | 10/2008 | Berger | A47K 11/10 15/104.93 |
| 2009/0097907 | A1 * | 4/2009 | Blom | B25G 3/38 403/122 |
| 2010/0095973 | A1 * | 4/2010 | Shrier | A46B 7/04 132/200 |
| 2016/0198923 | A1 * | 7/2016 | Stephens | B25G 1/06 15/147.1 |

* cited by examiner

*Primary Examiner* — Shay Karls
(74) *Attorney, Agent, or Firm* — Parlee McLaws LLP; Brenda Rhiannon Adams

(57) ABSTRACT

A pole handle of adjustable length with two sliding members is lockable with a clamp and a compact handle both have a ball joint or ball socket. The ball joint or ball socket have an aperture for an ejection rod. The pole handle and compact handle are used with cleaning pad with a ball socket or ball joint and the cleaning pad may be contained in a sealed housing with a lid penetrable with the ball joint or ball socket on the pole handle or compact handle. The cleaning pad is ejected by the pole handle or the compact handle with the ejection rod extending past the ball joint or ball socket.

18 Claims, 17 Drawing Sheets

CLEANING PAD HANDLES AND SYSTEMS

RELATED APPLICATION

This application claims priority from U.S. Provisional Patent Application No. 62/753,171, entitled "Cleaning Pad Handles and Container" filed on Oct. 31, 2018, the entire contents of which are incorporated herein by reference.

FIELD

Embodiments herein relate to systems and apparatus for cleaning surfaces. Specifically, embodiments herein relate to handles for use with cleaning pads.

BACKGROUND

Cleaning systems relating to mops and the like using disposable, washable, detachable and re-attachable cleaning heads are known and employed in order to allow users to use cleaning heads interchangeably with a single mop handle.

In U.S. Pat. No. 3,827,099 to Allaire et al., a disposable mop head is disclosed that may be used for cleaning purposes and disposed of without the need to dispose of other portions of the mop. Such disposable mop heads are advantageous because mop heads are commonly soiled or consumed much more quickly than other portions of the mop. Thus, in this manner, solid mop heads may be removed and disposed of, and new disposable mop heads may be re-attached without the expense of replacing other portions of the mop implement.

In U.S. Patent Application No. 2009/0097907A1 by Blom, a disposable mop head system is disclosed using a ball and joint connection between the mop handle and mop head. Blom teaches a method of ejecting a mop head requiring restraining the head and axially pulling on the handle to separate the mop head from the handle.

In U.S. Pat. No. 10,194,776 to the Applicant, a cleaning cartridge system is provided allowing the use of replaceable mop heads pre-soaked in cleaning solution. However, the system taught in the '776 patent requires the user to depress buttons located on the cleaning handle proximate the mop head, which potentially requires the user to contact portions of the handle.

SUMMARY

Embodiments herein relate to mop handles and related systems wherein mop heads are replaceable using cleaning cartridges and the replacement can occur without the user or the mop making direct contact with the cleaning surface of the mop head or soiled portions of the mop handle.

In one aspect, a pole handle includes an outer tube and an inner rod. The outer tube includes one of a ball joint or a ball socket at a ball joint end, an aperture in the ball joint or the ball socket, an open end with an inner bore extending between the ball joint end and the open end, and a clamp proximate to the open end for selectively locking a rod in an axial position within the inner bore. The inner rod can be slidably received in the inner bore. The inner rod includes an ejection assembly, which includes an ejection rod at a first end configured to fit through the aperture, and a resilient member at the first end for biasing the ejection assembly away from the ball joint end such that the ejection rod does not extend past the ball joint or the ball socket in a resting position until a user actuates the inner rod to an ejecting portion.

In another aspect, a compact handle includes an outer housing having an inner bore extending therethrough. The compact handle further includes one of a ball joint or a ball socket at a ball joint end, an aperture in the ball joint or the ball socket, an ejection button retained in the inner bore further comprising an ejection rod projecting from the ejection button and configured to fit the aperture, and a resilient member in the inner bore between the ball joint or the ball socket and the ejection button for biasing the ejection button away from the ball joint end such that the ejection rod does not extend past the ball joint or the ball socket in a resting position until a user actuates the ejection button to an ejecting position.

In another aspect, a mop cleaning system includes a cleaning pad module and a handle. The cleaning pad module includes a cleaning pad, a support member attached to the cleaning pad and having one of a ball socket or a ball joint. The handle having a ball joint or a ball socket at a ball joint end for rotatably and pivotably coupling with the ball socket or the ball joint.

DETAILED DESCRIPTION

Embodiments herein relate to handles, cleaning cartridges and cleaning systems. The description and figures provided are intended as a description of various embodiments and are not intended to represent the only embodiment contemplated. The detailed description includes specific details for the purpose of providing an understanding of the embodiments. However, it will be apparent to those skilled in the art that the embodiments may be practiced without these specific details.

Figure 1:
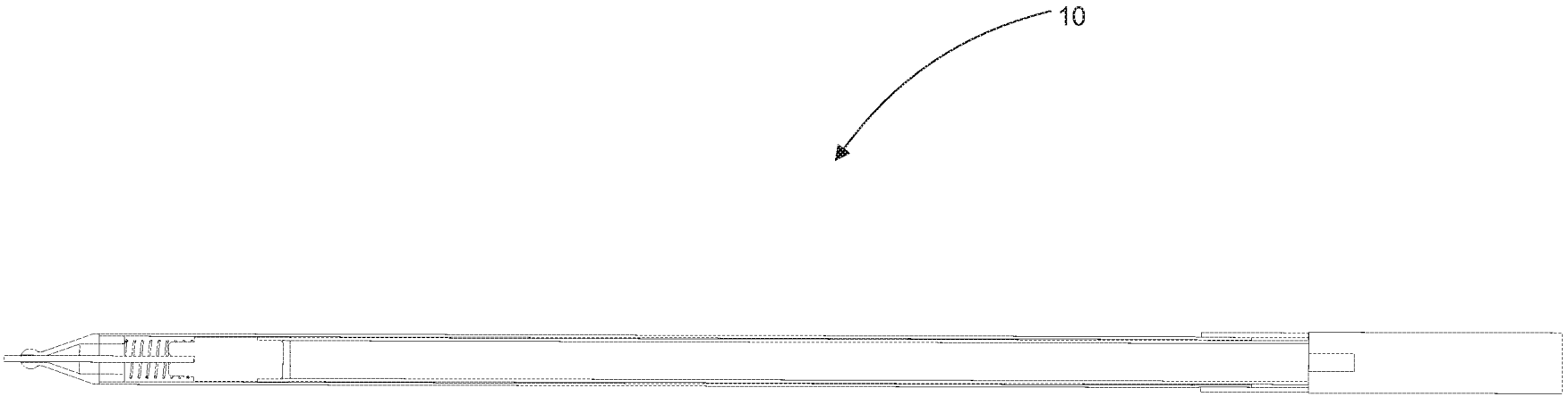
FIG. 1 is side section view of an embodiment a pole handle in an unextended state.
Figure 2:
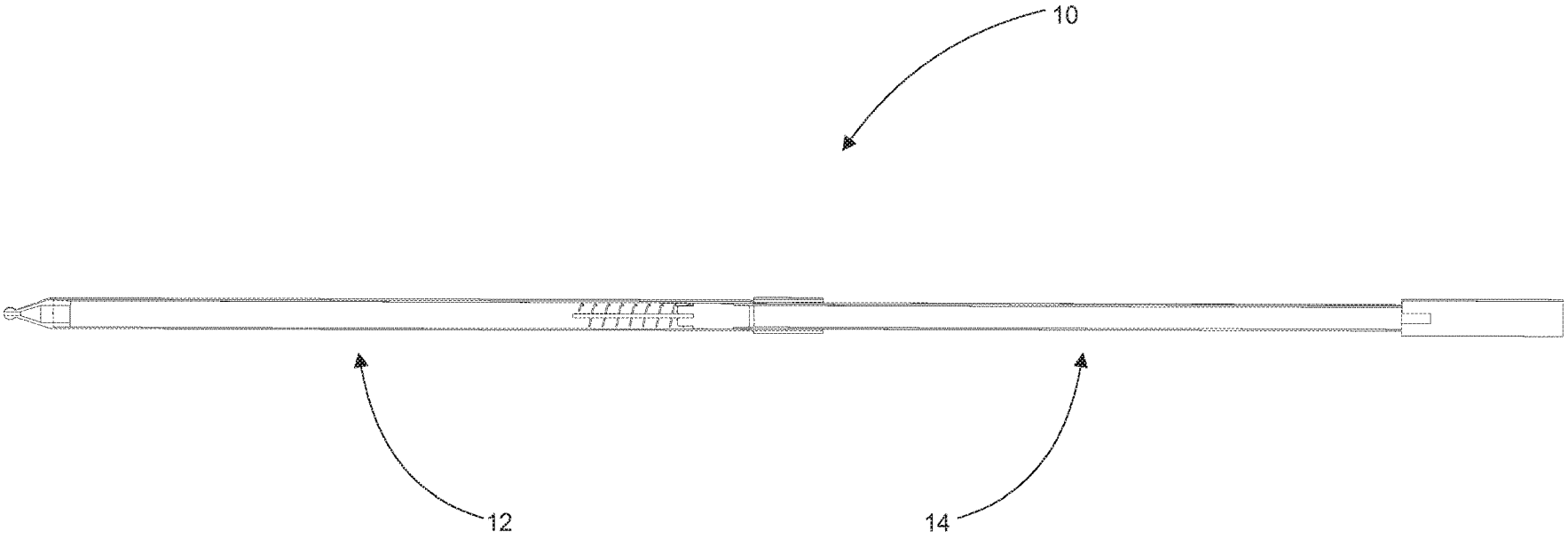
FIG. 2 is a side section view of the pole handle of FIG. 1 in an extended state.
Figure 3:
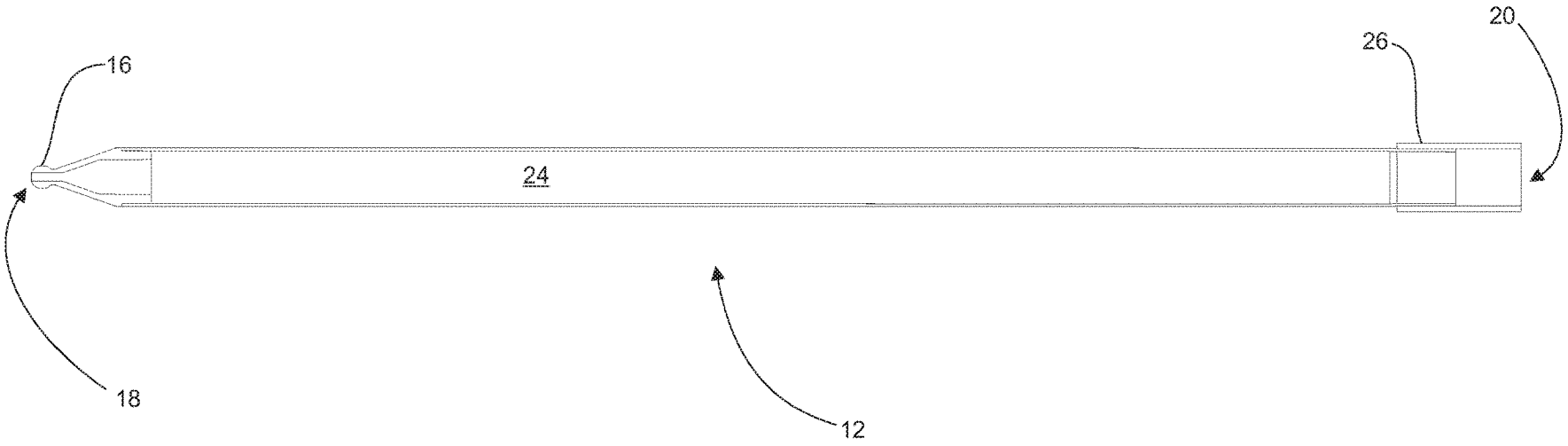
FIG. 3 is a side section view of an outer tube of the pole handle of FIG. 1.
Figure 4:
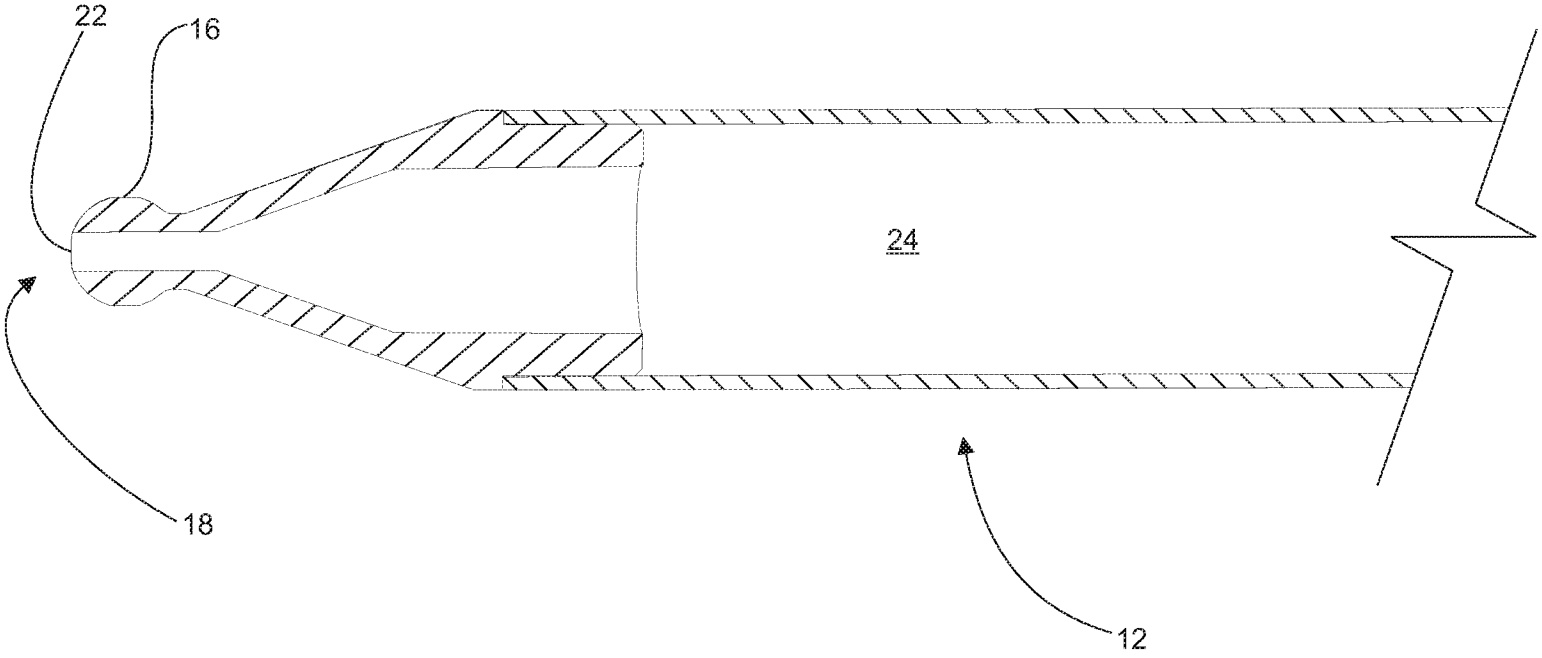
FIG. 4 is a detail section view of a ball joint end of the outer tube of the pole handle of FIG. 1.
Figure 5:
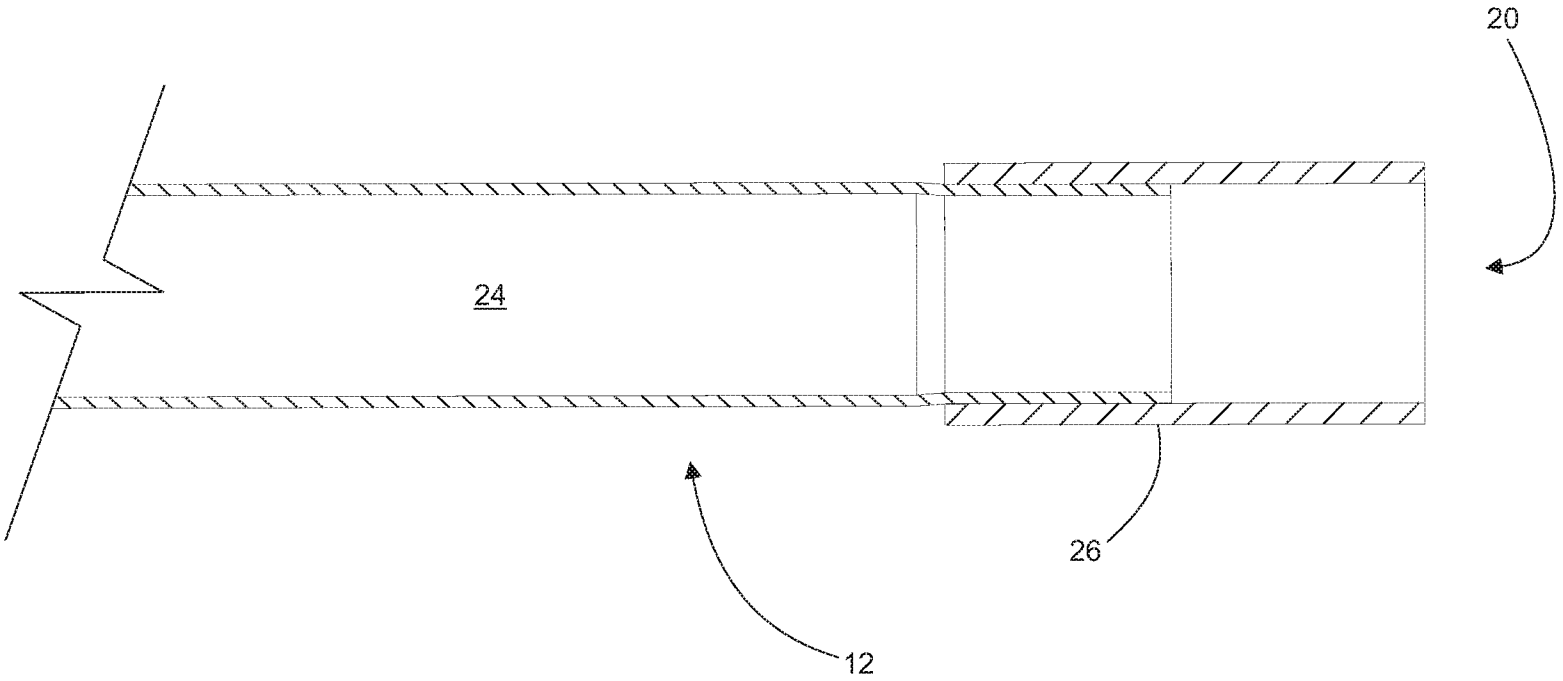
FIG. 5 is a detail section view of an open end of the outer tube of the pole handle of FIG. 1.

Referring to FIGS. 1 and 2, a pole handle 10 comprises an outer tube 12 and an inner rod 14. In embodiments, the inner rod 14 is a tubular member. Referring to FIGS. 3 to 5, the outer tube 12 comprises a ball joint 16 at a ball joint end 18 and an open end 20. The ball joint 16 further comprises an aperture 22. The outer tube 12 defines an inner bore 24 extending from the ball joint end 18 to the open end 20. The open end 20 further comprises a clamp 26. In embodiments, the clamp 26 is a twist and lock clamp or a latch clamp.

Figure 6:
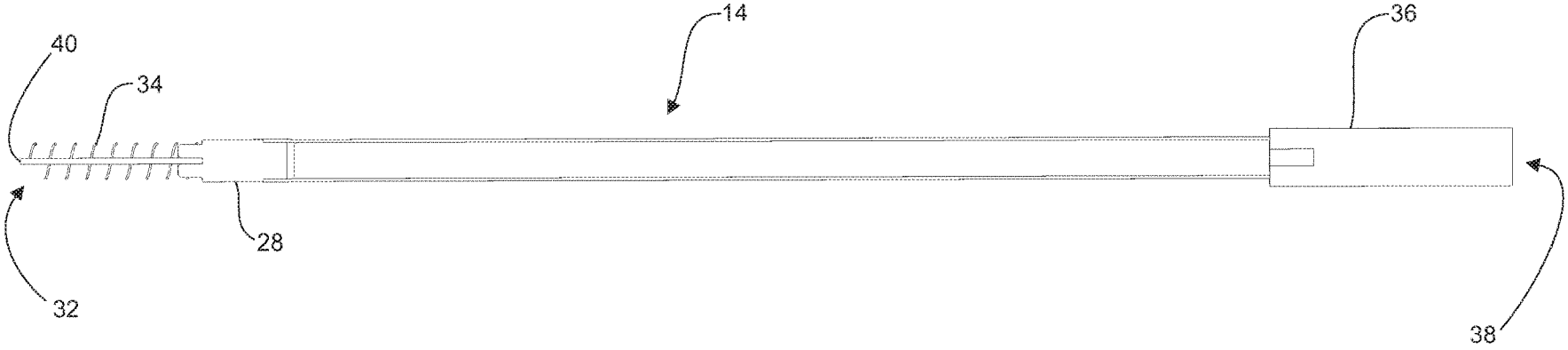
FIG. 6 is a side section view of an inner rod of the pole handle of FIG. 1.
Figure 7:
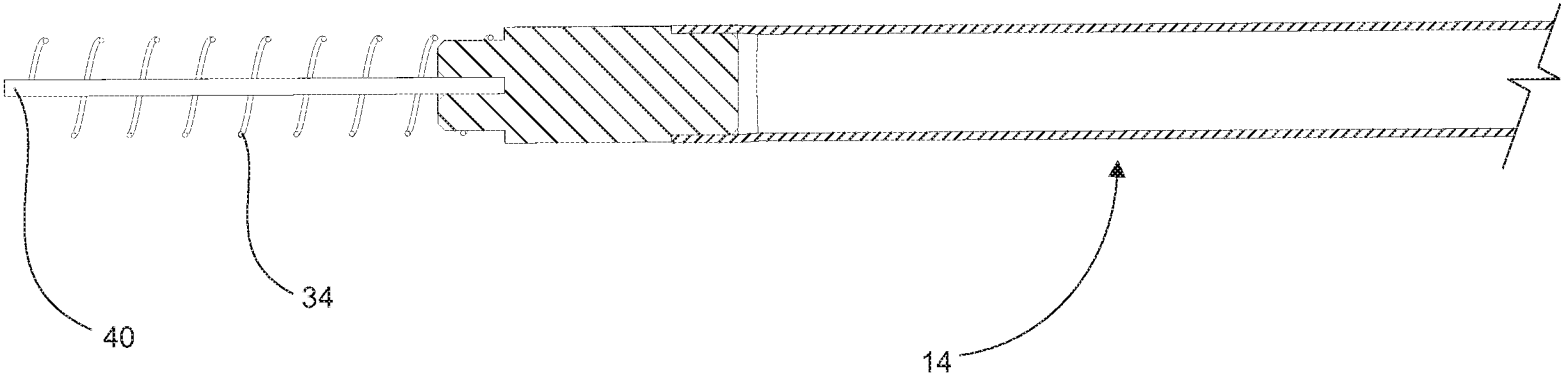
FIG. 7 is a detail section view of a first end of the inner rod of pole handle of FIG. 1.

Referring to FIGS. 6 and 7. the inner rod 14 is slideably receivable in the inner bore 24 and further comprises an ejection assembly 28 at a first end 32 and a resilient member 34, such as a spring. In embodiments, the inner rod 14 further comprises a grip 36 at a second end 38 to provide improved grip. The ejection assembly 28 comprises an ejection rod 40 protruding from a receiver and is connected to, or integral with, with the first end. The resilient member 34 can be fixed or attached to the second end 38 or the ejection assembly 28.

Figure 8A:
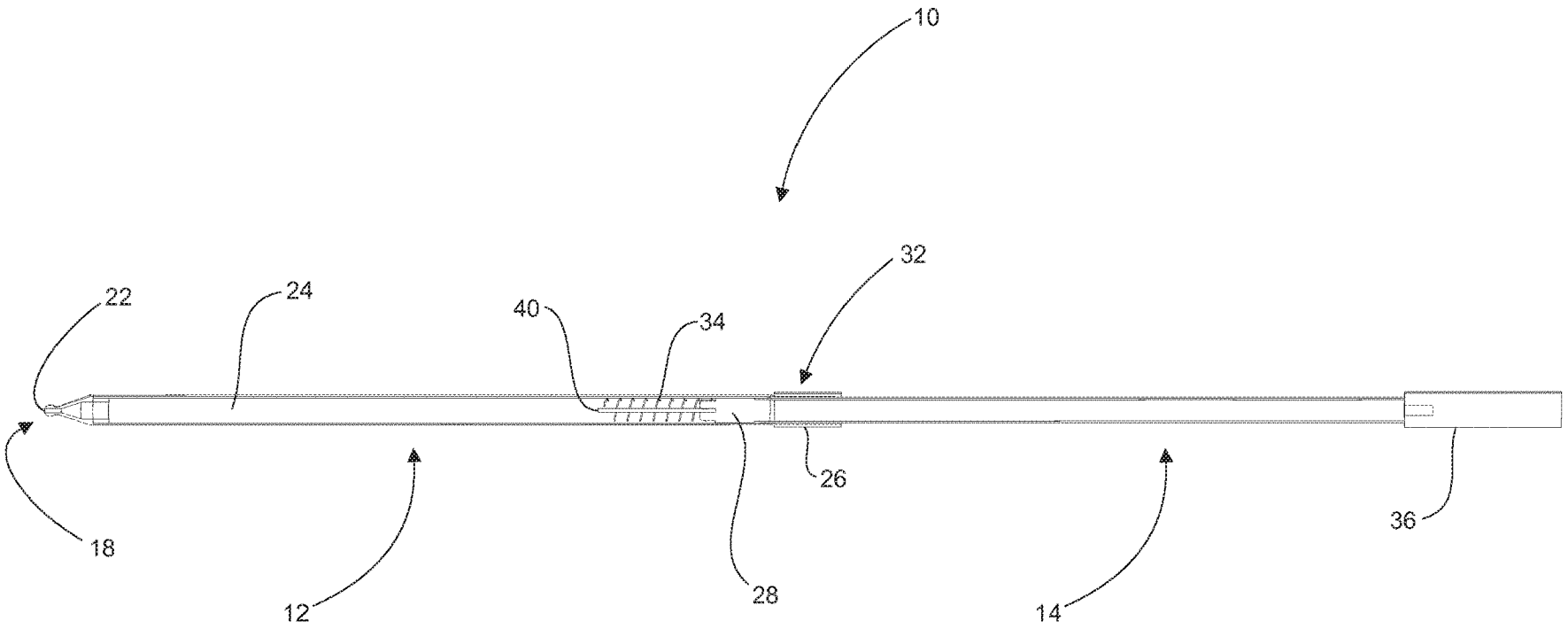
FIGS. 8A and 8B are side section views of the pole handle of FIG. 1 wherein an ejection rod is in an unejecting state and an ejecting state, respectively.
Figure 8B:
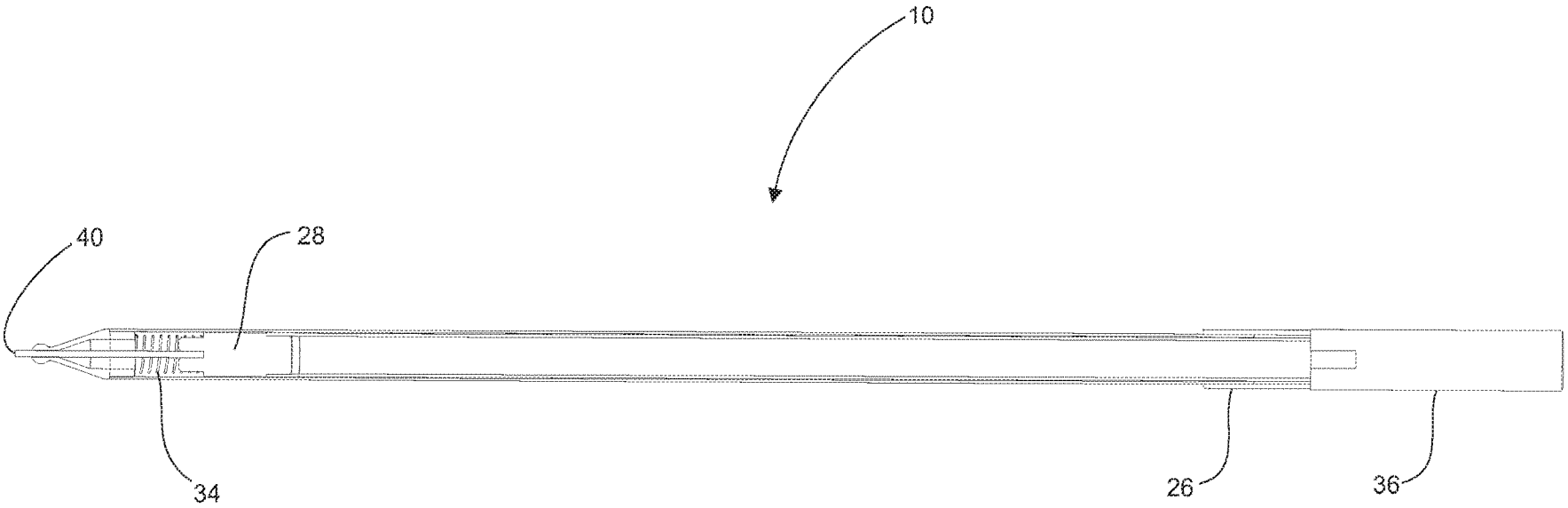

Referring to FIGS. 8A and 8B, when the inner rod 14 is placed within the outer tube 12 such that the first end 32 of the inner rod 14 is proximate the ball joint end 18 of the outer tube 12, the ejection rod 40 is biased away therefrom by the resilient member 34 and is located within the aperture 22 but is retained in the inner bore 24 by the ball joint 16. In this resting position, the resilient member 34 is located between the ball joint 16 and the ejection assembly 28 such that the ejection rod 40 does not extend past the ball joint 16 through the aperture 22. The resilient member 34 and the aperture 22 are sized so that the resilient member 34 does not fit through the aperture 22. The resilient member 34 has a suitable compression strength such that a user is able to apply a manual axial force upon the ejection rod 40 to overcome the biasing force of the resilient member 34 such that the ejection rod 40 extends past the aperture 22 to an ejecting position. For example, the inner rod 14 or a button thereon can be operatively connected to the ejection rod 40 such that a force applied on the inner rod 14 or button is translated to axial movement of the ejector rod 40 past the aperture 22. The position of the inner rod 14 can be fixed relative to the outer tube 12 by engaging the clamp 26 into a closed position, for example to lock the pole handle 10 in an extended configuration. When the clamp 26 is in an open position, the inner rod 14 can freely slide within the inner bore 24.

Figure 9:
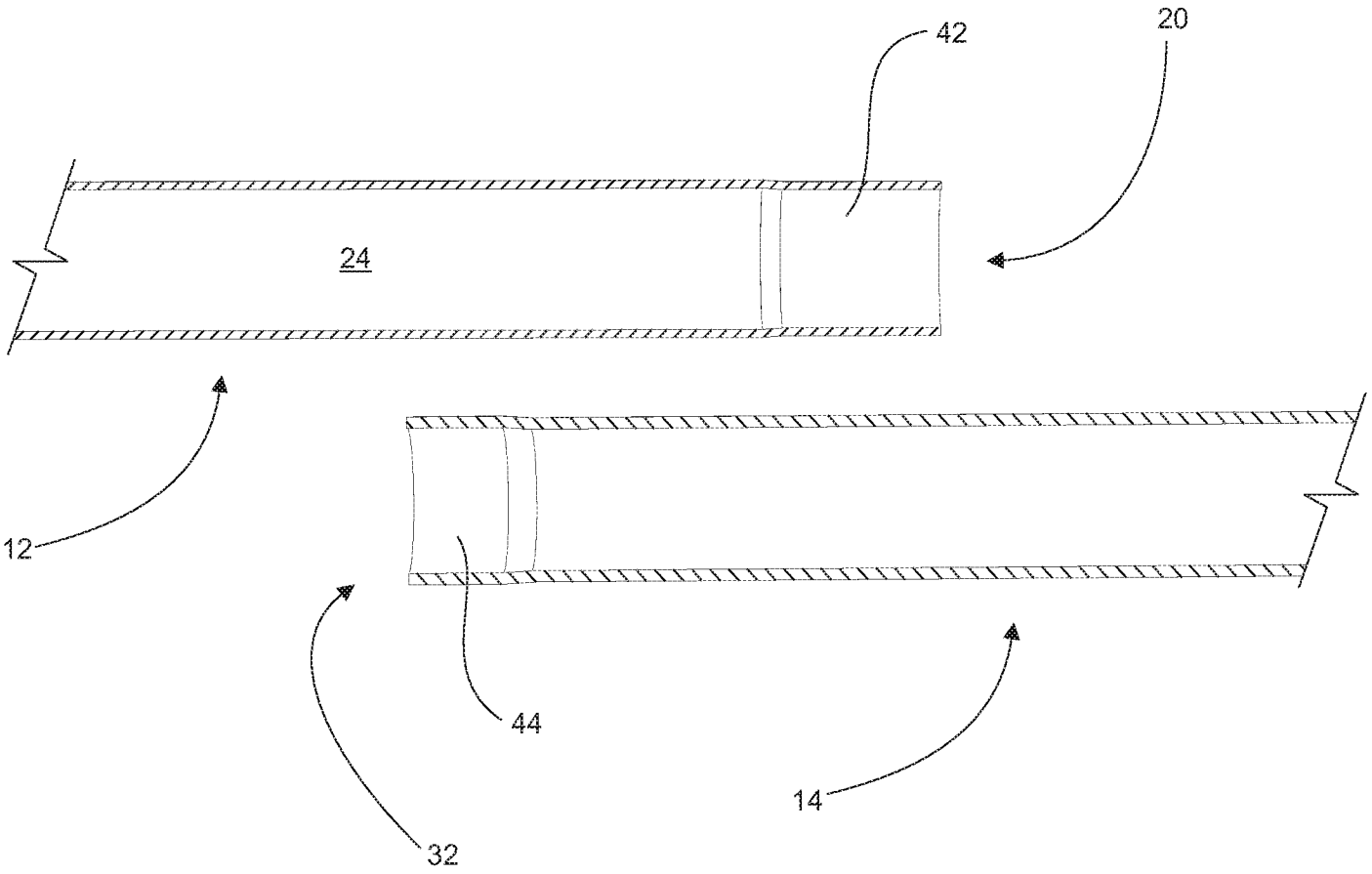
FIG. 9 is an exploded detail section view of the pole handle illustrating a radially inward lip on the outer tube and a radially outward lip on the inner rod of the pole handle of FIG. 1.

Referring to FIG. 9, in embodiments, the inner bore 24 has an inward radial lip 42 at the open end 20 and the inner rod 14 has an outward radial lip 44 at the first end 32. The inward lip 42 defines a circular opening that is larger than the outside diameter of the inner rod 14. Correspondingly, an outer diameter of the outward lip 44 is smaller than the inner bore 24 but is larger than the inner diameter of the inward lip 42. In embodiments, the inward lip 42 and the outward lip 44 cooperate to allow the inner rod 14 to slide within the inner bore 24 while preventing the inner rod 14 from being pulled out of the outer tube 12 via the open end 20.

To assemble the pole handle 10, the ejection rod 40 is installed into the ejection assembly 28 if they are separate pieces. The ejection assembly 28 and resilient member 34 are then installed on the first end 32 of the inner rod 14. The clamp 26 is then attached to the outer tube 12 and actuated to an open position. The inner rod 14 is then inserted into the outer tube 12 by inserting second end 38 of the inner rod 14 through the ball joint end 18 without the ball joint 16 installed thereon. The grip 36 is then installed on the second end 38 and the ball joint 16 is installed on the ball joint end 18. The components above can be installed or attached using adhesive, welding, fastening means such as threaded connections or screws, or any other appropriate method. The components of the pole handle 10 can be composed of metal, plastic or any other appropriate material.

Figure 10:
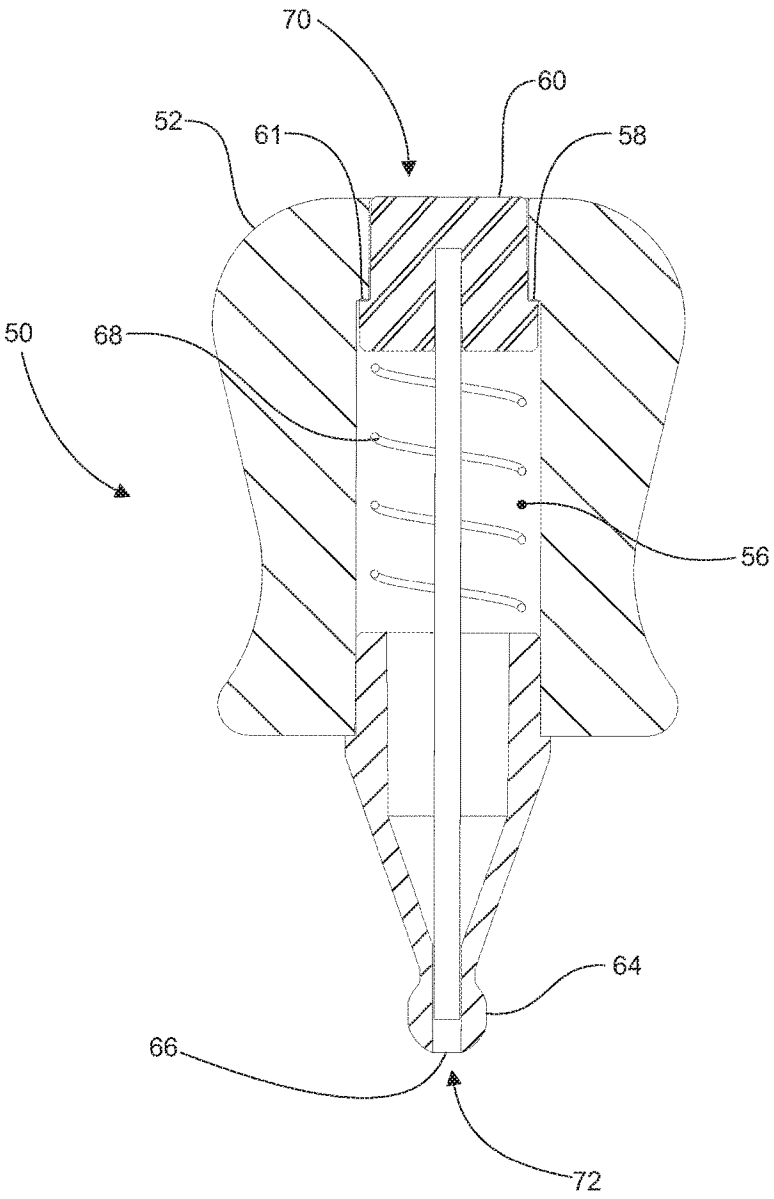
FIG. 10 is a side section view of an embodiment of a compact handle.

Referring to FIG. 10, a compact handle 50 comprises an outer housing 52, a ball joint 64, an ejection button 60, an ejection rod 62 and a resilient member 68. The outer housing 52 defines an inner bore 56 extending therethrough. The inner bore 56 comprises an inner lip 58 proximate to a first end 70. The compact handle 50 comprises the ball joint 64 at a second end 72 of the inner bore 56. The ball joint 64 comprises an aperture 66 extending axially therethrough. An ejection button 60 with a flange 61 to engage with the inner lip 58 of the inner bore 56 is located at the first end 70. The ejection button 60 is further connected to an ejection rod 62. In embodiments, the ejection button 60 and the ejection rod 62 can be integral. In other embodiments, the ejection button 60 and the ejection rod 62 can be separate pieces that are coupled together. For example, a rod bore can be formed in the ejection button 60 to receive the ejection rod 62 and they may be threaded or glued together. A resilient member 68, such as a spring, is located between the ball joint 64 and the ejection button 60 and configured to bias the button 60 away from the ball joint 64. The ejection rod 62 fits through the aperture 66. The resilient member 68 biases the ejection button 60 away from the ball joint 64 such that the flange 61 engages the lip 58 in a resting position. The resilient member 68 and the aperture 66 are sized so that the resilient member 68 does not fit through the aperture 66. The resilient member 68 has a suitable compression strength such that a user is able to apply a manual axial force upon the ejection button 60 such that the ejection rod 62 extends past the aperture 66 to protrude out of the ball joint 64 in an ejection position.

To assemble the compact handle 50, the ejection rod 68 is installed into the ejection button 60 if they are separate pieces. The ejection button 60 and resilient member 68 are then placed into the inner bore 56 through the second end 72. The ball joint 64 is installed on the second end 72. The components above can be installed or attached using adhesive, welding, fastening means such as threaded connections or screws, or any other appropriate method. The components of the compact handle 50 can be composed of metal, plastic or any other appropriate material.

Figure 11:
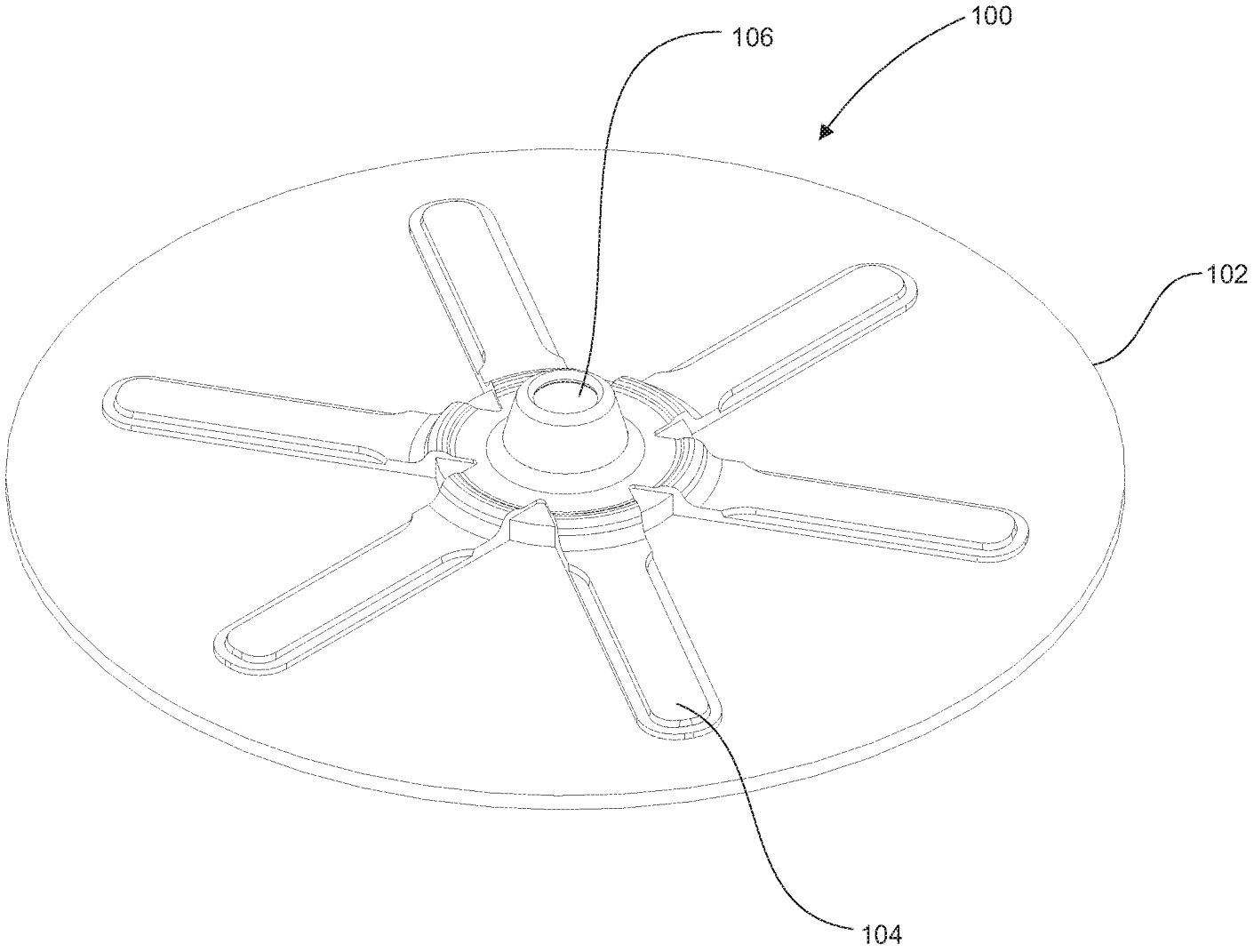
FIG. 11 is a perspective view of an embodiment of a cleaning pad.

Referring to FIG. 11, a cleaning pad 100 comprises a cleaning element 102, a support member 104 and a ball socket 106. The cleaning element 102 is attached or secured to the support member 104. The ball socket 106 is integral with or connected to the support member 104, such as to a central hub thereof.

In embodiments, the cleaning element 102 is composed of a single or plurality of layers of appropriate material. In embodiments, the support member 104 can comprise a plurality of fingers or any other appropriate arrangement extending from the central hub. In embodiments, the support member 104 is triangular, square, rectangular, pentagonal, hexagonal, circular or any other appropriate shape. In embodiments, the support member 104 is made of a material of some stiffness to provide structural integrity to the cleaning element 102. In embodiments, the support member 104 is made of plastic, metal, rubber or any other appropriate material. In embodiments, the ball socket 106 is composed of metal, plastic, rubber or any other appropriate resilient material that allows the ball socket 106 to expand to receive a ball joint and removeably retain the cleaning element 102 thereto.

Figure 12:
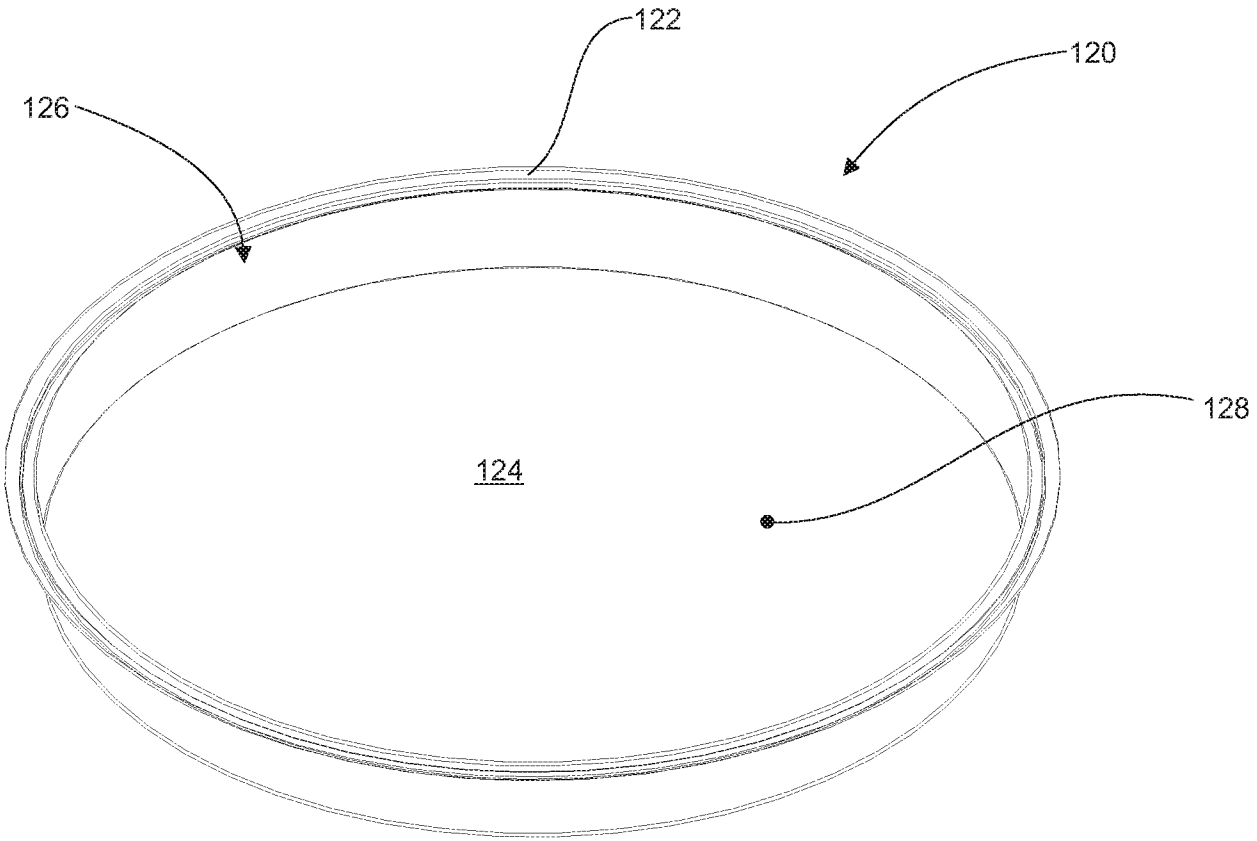
FIG. 12 is a perspective view of an embodiment of a cleaning pad module containing the cleaning pad of FIG. 11.

Referring to FIGS. 11 and 12, a cleaning pad module 120 comprises a housing 122 defining a chamber 124 for containing the cleaning pad 100. A mouth 126 provides open access to the chamber 124. In embodiments, the housing can be made of plastic, polyproplyene constructed with injection molding, or any other appropriate material. In embodiments, the cleaning pad module 120 further comprises a lid 128 to seal the mouth 126. In embodiments, the lid 128 is a foil or plastic film or other suitable material that can be punctured with a ball joint end of a device such as the pole handle 10 or the compact handle 50. The ball joint end of a device can then couple with the ball socket 106 of the cleaning pad 100 with the remainder of the lid 128 initially intact. While connected to a suitable handle, the cleaning pad 100 can then be withdrawn from the cleaning pad module 120 for scrubbing or otherwise cleaning a surface. The ball and socket joint allows for free pivoting and rotation of the cleaning pad 100 when coupled with an appropriate handle having a ball joint.

The cleaning pad 100 may contain specialized cleaning solutions and elements prior to installation of the cleaning pad 100 into the cleaning pad module 120 and the sealing thereof with the lid 128. For example, specialized solutions or elements for hardwood surfaces, tile surfaces, dry sweeping, absorbing spilled liquids, etc. can be used.

Figure 13:
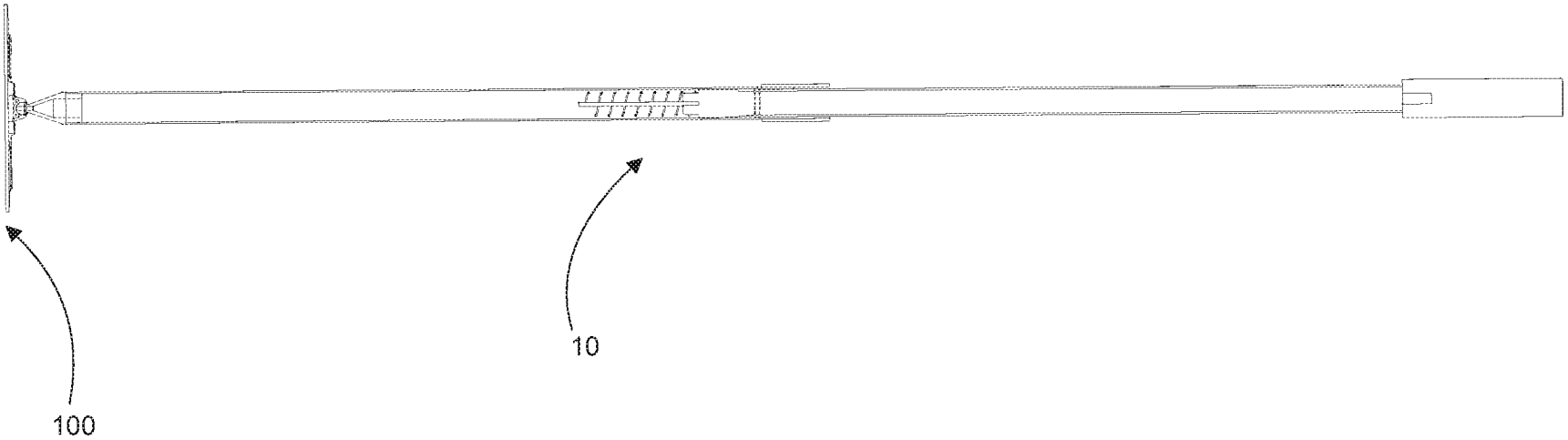
FIG. 13 is a side section view of the pole handle of FIG. 1 attached to the cleaning pad of FIG. 11.
Figure 14:
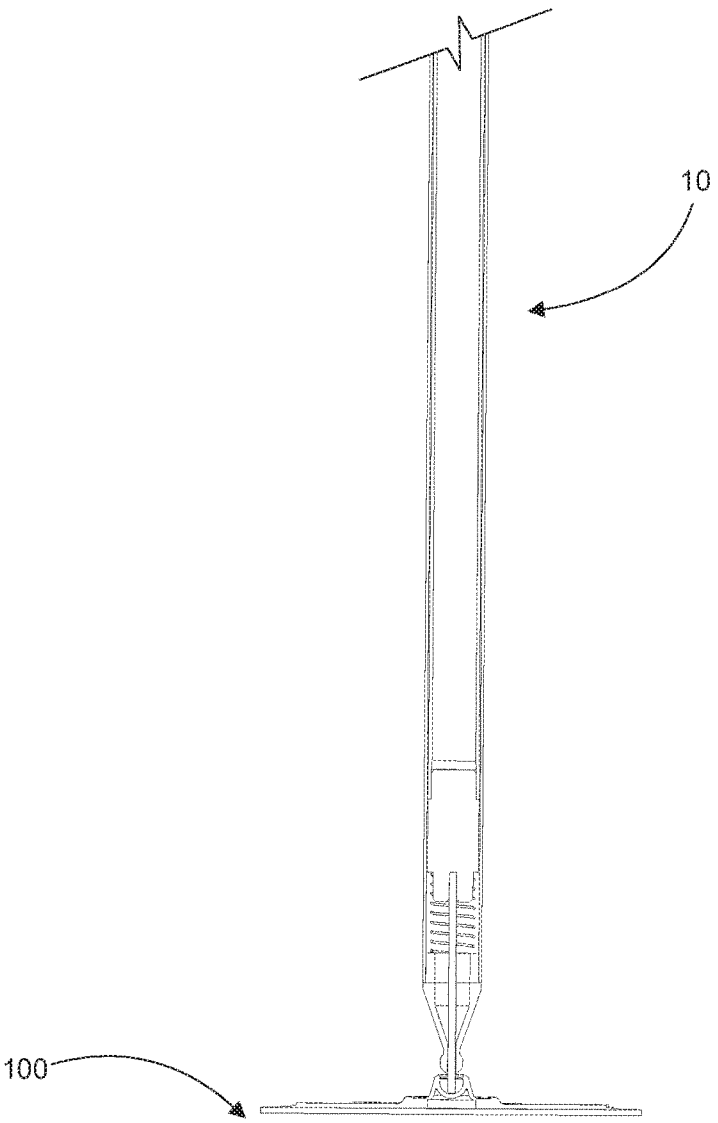
FIG. 14 is a side section view of the compact handle of FIG. 10 attached to the cleaning pad of FIG. 11.

Referring to FIG. 13, the cleaning pad 100 can be attached to the pole handle 10 by inserting the ball joint 16 into the ball socket 106. When the clamp 26 of the pole handle 10 is closed, the inner rod 14 is fixed with the outer tube 12 to form a rigid handle of adjustable length, and used to clean surfaces. Referring to FIG. 14, when the clamp 26 is open, axial force can be applied from the grip 36 towards the ball joint 16 pushing the ejection rod 40 through the aperture 22 to separate the ball joint 16 from the ball socket 106.

Figure 15:
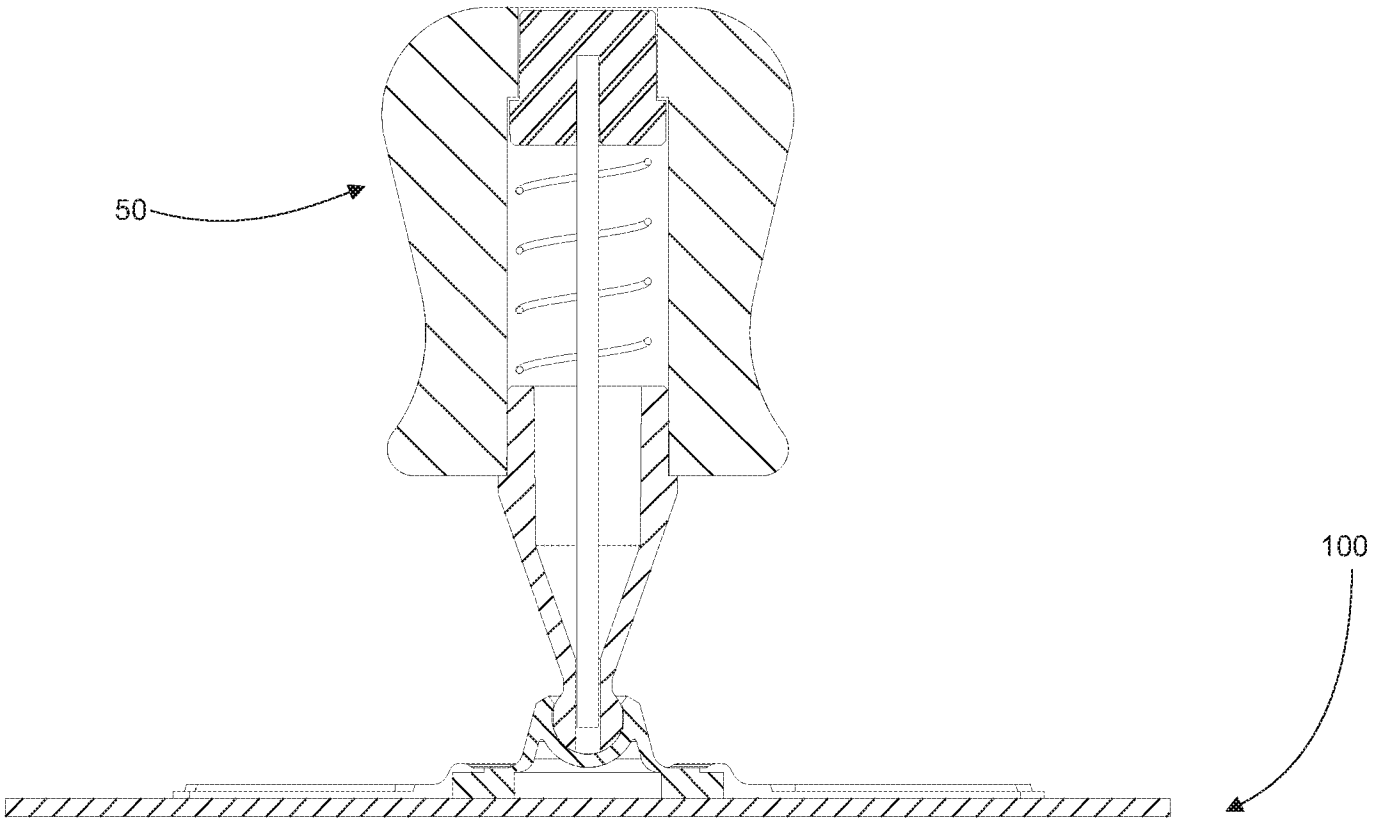
FIG. 15 a detail side section view of the pole handle of FIG. 1 ejecting the cleaning pad of FIG. 11.
Figure 16:
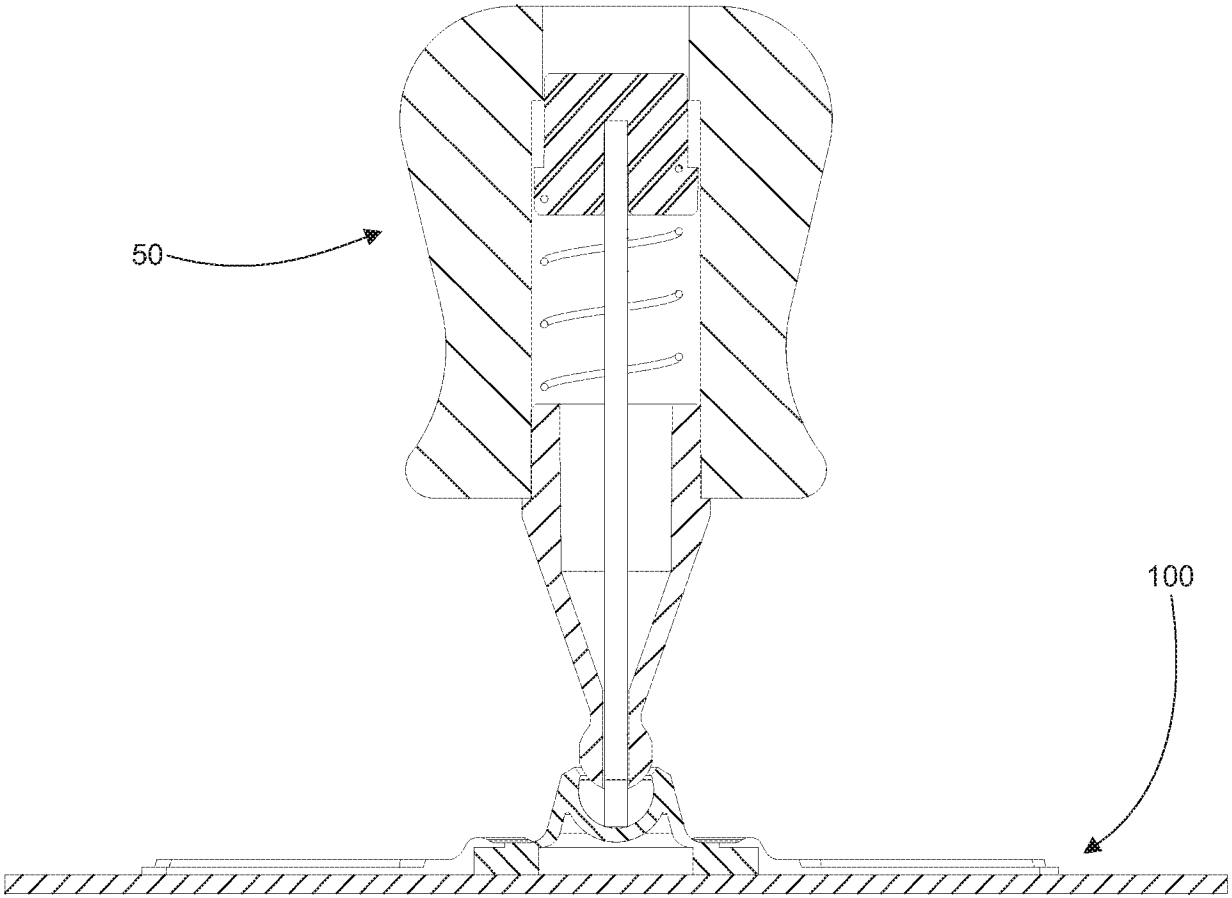
FIG. 16 is a side section view of the compact handle of FIG. 10 ejecting the cleaning pad of FIG. 11.

Referring to FIG. 15, the cleaning pad 100 can also be attached to the compact handle 50 by inserting the ball joint 64 into the ball socket 106. Referring to FIG. 16, axial force can be applied from the ejection button 60 towards the ball joint 64 pushing the ejection rod 62 through the aperture 66 to separate the ball joint 64 form the ball socket 106.

The ball and socket joint allows for free pivoting and rotation of the cleaning pad 100 relative to the pole handle 10 or the compact handle 50. In embodiments, the cleaning pad 100 comprises a ball joint and the pole handle 10 and compact handle 50 comprise a ball socket having an aperture for allowing the ejection rod 40, 62 to extend therethrough to the ejecting position. The ball joints fit into the ball sockets by any means known in the art, such as via a snap fit.

Ejection and disposal of the cleaning pad 100 in this manner does not require the user to touch the cleaning pad 100. Once the applied axial force is removed, the ejection rod 40, 60 retracts to the resting position into the pole handle 10 or compact handle 50 to prevent damage to or by the ejection rod 40, 60, and to allow a new cleaning pad 100 to be coupled. Through the entire cleaning process, the user is not required to directly touch the cleaning element 102.

Although a few embodiments have been shown and described, it will be appreciated by those skilled in the art that various changes and modifications can be made to those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

The embodiments in which an exclusive property or privilege is claimed are defined as follows:

1. A pole handle comprising
- an outer tube further comprising
  - one of a ball joint or a ball socket at a ball joint end configured to rotatably and pivotably connect with a corresponding ball socket or ball joint of a cleaning pad module,
  - an aperture formed in the ball joint or ball socket,
  - an open end with an inner bore extending between the ball joint end and the open end, and
  - a clamp proximate to the open end; and
- an inner rod slidably received in the inner bore, the inner rod comprising
  - an ejection assembly comprising an ejection rod at a first end configured to fit through the aperture and extend past the ball joint or ball socket in an ejecting position wherein the inner rod and outer tube are telescopically collapsed, and
  - a resilient member at the first end for biasing the ejection assembly away from the ball joint end such that the ejection rod does not extend past the ball joint or ball socket in a resting position wherein the inner rod and the outer tube are telescopically extended.

2. The pole handle of claim 1 further comprising a handle on a second end of the inner rod.

3. The pole handle of claim 1 wherein the clamp is a twist lock clamp.

4. The pole handle of claim 1 wherein the clamp is a latch clamp.

5. The pole handle of claim 1 wherein inner bore has a radially inward lip at the open end and the inner rod has a radially outward lip at the first end.

6. The pole handle of claim 1, wherein the cleaning pad module comprises:
- a cleaning pad, and
- a support member attached to the cleaning pad and comprising the corresponding ball socket or the ball joint of the cleaning pad module.

7. The pole handle of claim 1, wherein the resilient member is a coil spring.

8. The pole handle of claim 1, wherein the resilient member is attached to the first end of the ejection rod.

9. A compact handle comprising
- an outer housing comprising an inner bore extending therethrough;
- one of a ball joint or a ball socket at a second end configured to rotatably and pivotably connect with a corresponding ball socket or ball joint of a cleaning pad module;
- an aperture formed in the ball joint or ball socket;
- an ejection button retained in the inner bore further comprising an ejection rod projecting from the ejection button and configured to fit through the aperture and extend past the ball joint or ball socket in an ejecting position; and
- a resilient member in the inner bore between the ball joint or ball socket and the ejection button for biasing the ejection button away from the second end such that the ejection rod does not extend past the ball joint or ball socket in a resting position.

10. The compact handle of claim 9 wherein the cleaning pad module comprises:

a cleaning pad, and a support member attached to the cleaning pad and comprising the corresponding ball socket or the ball joint of the cleaning pad module.

11. The compact handle of claim 9, wherein the resilient member is a coil spring.

12. A cleaning system, comprising a cleaning pad module having at least one cleaning pad;

a support member attached to the at least one cleaning pad and comprising one of a ball socket or a ball joint;

a handle further comprising a ball joint or a ball socket at a ball joint end for rotatably and pivotably coupling with the ball socket or ball joint of the support member;

an outer housing defining a chamber for containing the at least one cleaning pad and support member, and a mouth providing open access to the chamber; and a lid for sealing the mouth penetrable with the ball joint or ball socket of the handle.

13. The cleaning system of claim 12, wherein the support member is a plurality of fingers.

14. The cleaning system of claim 13, wherein the fingers extend from a hub having the ball socket or ball joint of the support member.

15. The cleaning system of claim 12, wherein the lid is a plastic film.

16. The cleaning system of claim 12, wherein the handle comprises an outer tube further comprising the ball joint or ball socket of the handle, an aperture formed in the ball joint or the ball socket of the handle, an open end with an inner bore extending between the ball joint end and the open end, and a clamp proximate to the open end; and an inner rod slidably received in the inner bore, the inner rod comprising an ejection assembly comprising an ejection rod at a first end configured to fit through the aperture and extend past the ball joint or ball socket in an ejecting position wherein the inner rod and outer tube are telescopically collapsed, and a resilient member at the first end for biasing the ejection assembly away from the ball joint end such that the ejection rod does not extend past the ball joint first ball socket of the handle in a resting position wherein the inner rod and the outer tube are telescopically extended.

17. The cleaning system of claim 12, wherein the handle comprises an outer housing comprising an inner bore extending therethrough;

the ball joint or ball socket of the handle located at a second end;

an aperture formed in the ball joint or ball socket of the handle;

an ejection button retained in the inner bore further comprising an ejection rod projecting from the ejection button and configured to fit through the aperture and extend past the ball joint or ball socket in an ejecting position; and a resilient member in the inner bore between the ball joint or ball socket of the handle and the ejection button for biasing the ejection button away from the second end such that the ejection rod does not extend past the ball joint or ball socket of the handle in a resting position.

18. The cleaning system of claim 12, wherein the cleaning pad contains a cleaning solution.

* * * * *